United States Patent [19]

Coffin

[11] Patent Number: 4,985,995

[45] Date of Patent: Jan. 22, 1991

[54] RAZOR HEAD, ESPECIALLY A RAZOR BLADE UNIT

[75] Inventor: Dave Coffin, Norwich, United Kingdom

[73] Assignee: Wilkinson Sword Gesellschaft mit beschränkter Haftung, Solingen, Fed. Rep. of Germany

[21] Appl. No.: 401,019

[22] Filed: Aug. 31, 1989

[30] Foreign Application Priority Data

Sep. 8, 1988 [DE] Fed. Rep. of Germany ... 8811356[U]

[51] Int. Cl.[5] ..... B26B 21/14

[52] U.S. Cl. ..... 30/84; 30/50; 30/60.5

[58] Field of Search ..... 30/84, 32, 47, 50, 60.5

[56] References Cited

U.S. PATENT DOCUMENTS 4,328,615 5/1982 Bowman et al. ..... 30/84 X

FOREIGN PATENT DOCUMENTS 557491 8/1932 Fed. Rep. of Germany .
2701271 7/1977 Fed. Rep. of Germany .
2851457 6/1979 Fed. Rep. of Germany .
2638788 2/1984 Fed. Rep. of Germany .
8711506 10/1987 Fed. Rep. of Germany .
2009017 6/1979 United Kingdom .
1587317 4/1981 United Kingdom .
2164598 3/1986 United Kingdom .
2171630 9/1986 United Kingdom .

*Primary Examiner*—Frank T. Yost
*Assistant Examiner*—Willmon Fridie, Jr.
*Attorney, Agent, or Firm*—Robert W. Becker & Associates

[57] ABSTRACT

A razor head, especially a razor blade unit, having a single or double razor blades fixedly disposed in a plastic housing and resting on a blade support of the housing. If a double razor blade is provided, a spacer is disposed between the two blades. To provide a razor head of simple construction with straightforward fixation for the razor blades in the housing, the housing has an opening for the blades that is accessible from above, with the blades being introduced into the opening from above and onto the blade support. A cover or cap is placed on the housing to thereby fixedly and firmly hold the cover in position thereon, with the single or double blades being fixed between the cover and the blade support.

10 Claims, 3 Drawing Sheets

RAZOR HEAD, ESPECIALLY A RAZOR BLADE UNIT

BACKGROUND OF THE INVENTION

The present invention relates to a razor head, especially a razor blade unit, having a single or double razor blade fixedly disposed in a plastic housing and resting on a blade platform or support of the plastic housing, whereby if a double razor blade is provided a spacer is disposed between the two razor blades The plastic housing, together with the single or double razor blade, can be wrapped with wire.

With disposable wet razors, a single or double razor blade is fixedly disposed in the razor head in a plastic housing. The term "fixedly" means that replacement of a used razor blade by a new blade is not intended. If the razor head is separately embodied and can be secured to a handle, for which purpose the handle as well as the razor head have cooperating interlocking means, the razor head is referred to as a so-called razor blade unit.

With the heretofore known razor heads, and in particular with the heretofore known razor blade units, the fixation of the razor blade or blades within the plastic housing, and hence the overall assembly, is complicated and expensive. In particular, it has up to now been necessary to rivet or otherwise fasten together the individual parts of the razor head, for example by placing a cap or cover on the plastic housing to fix the single or double razor blades in the housing after they have been introduced therein, and then appropriately fastening the cover to the plastic housing. This can be undertaken only at great technical expenditure, for which purpose specialized machines are furthermore required.

It is therefore an object of the present invention to provide a razor head that is straightforward in construction and has simple means for securing the single or double razor blade within the plastic housing.

BRIEF DESCRIPTION OF THE DRAWINGS

This object, and other objects and advantages of the present invention, will appear more clearly from the following specification in conjunction with the accompanying schematic drawings, in which, via one exemplary embodiment of the inventive razor having a head in the form of a razor blade unit.

SUMMARY OF THE INVENTION

Figure 1:
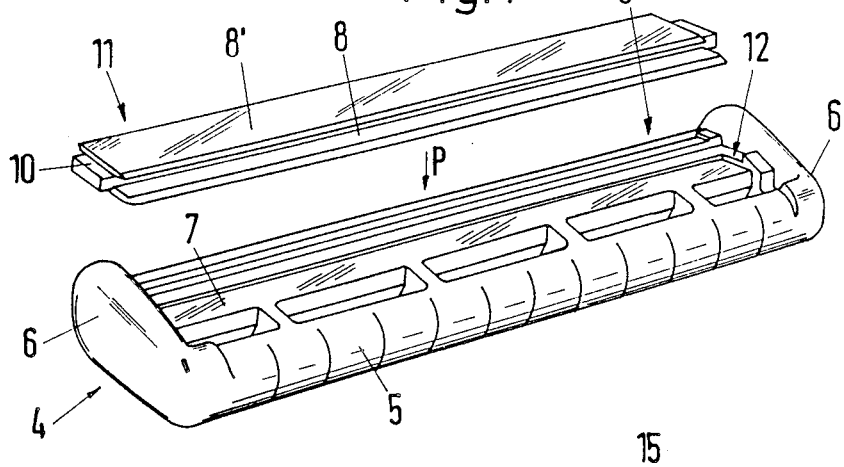
FIG. 1 is a perspective view of a razor blade, unit prior to placement of the double razor blade into the plastic housing from above.

The razor head or razor blade unit of the present invention is characterized primarily in that: the plastic housing has an opening for the single or double razor blades, with this opening being accessible from above, and with the single or double razor blades being introduced into the opening from above and onto the blade support of the plastic housing; and a cover or cap is placed on the plastic housing to thereby fixedly and firmly hold the cover in position thereon, with the single or double razor blades being fixed between the cover and the blade support of the housing.

A razor head constructed pursuant to the present invention has the advantage of providing a technically very straightforward fixation of the single or double razor blade within the plastic housing. It is merely necessary to insert the single or double razor blades from above into the plastic housing, and to subsequently place thereon the cover, which on the one hand is securely connected with the plastic housing, and on the other hand firmly holds the single or double razor blades in position on the blade support of the housing. As a result, it is in particular no longer necessary to undertake expensive riveting or fastening of the individual components during assembly of the razor head. In particular, it is no longer necessary to rivet the cover to the plastic housing, since fixation of the cover to the plastic housing is achieved merely by placing the cover on the housing. In this connection, the cover, which is placed on the plastic housing and overlaps the blades from above while leaving the cutting edges exposed, additionally assumes the function of the caps of the heretofore known razor heads, and defines the razor geometry together with the front guide strip as well as the razor blades.

Although the cover can be frictionally connected to the plastic housing and can be firmly held in position thereon via a press fit, it is proposed pursuant to a further development of the inventive razor head that engagement means be provided between the cover and the plastic housing. Via this engagement means, the cover is firmly held in position on the plastic housing in an extremely reliable manner, and cannot be accidentally detached therefrom. In this connection, when the cover is placed upon the plastic housing, the cover is locked in its final position.

In one preferred specific embodiment of the present invention, the cover is a cap that has an essentially U-shaped cross-sectional profile, is placed upon the plastic housing from the rear, and extends over essentially the entire length of the plastic housing. This represents a technically very easy to manipulate the cover for fixing the single or double razor blades within the plastic housing, since the cap is placed upon the plastic housing in such a way as to embrace the housing from the rear. In so doing, the upper leg of the cap forms the cover. This cap is particularly suitable for use when the plastic housing together with the single or double razor blades are wrapped with wire since the embracing cap additionally fixes the wire wrappings on a plastic housing, and provides an additional protection against lateral slippage.

If the cover, in the form of a cap, is provided with engagement means, then pursuant to a further specific feature of the present invention, each end of the cap is provided with an engagement arm that extends toward the front and is in turn provided with a catch, with the plastic housing having corresponding receiving means therefor. This assures a very reliable connection between the plastic housing and the U-shaped cap that is placed thereon from behind, this being the case without the danger that the cap can become accidentally or unintentionally detached, for example during the shaving process.

Instead of using an engagement means, the cover could also be comprised of a material that can contract, especially plastic. In this way, a reliable and secure connection can be provided between the cover and the plastic housing by heating the cover, in particular the aforementioned cap, so that this cover expands. After the cover is installed and the material is cooled, all of the parts are securely held together.

It is finally proposed in a further development of the inventive razor head, that the cover, which is comprised in particular of plastic, is provided with a sliding or lubricating film. With such a film, the coefficient of friction between the razor head and the skin of the user is reduced during shaving, thus providing a comfortable shave due to the reduced friction.

Further specific features of the present invention will be described in detail subsequently.

DESCRIPTION OF PREFERRED EMBODIMENTS

Figure 2:
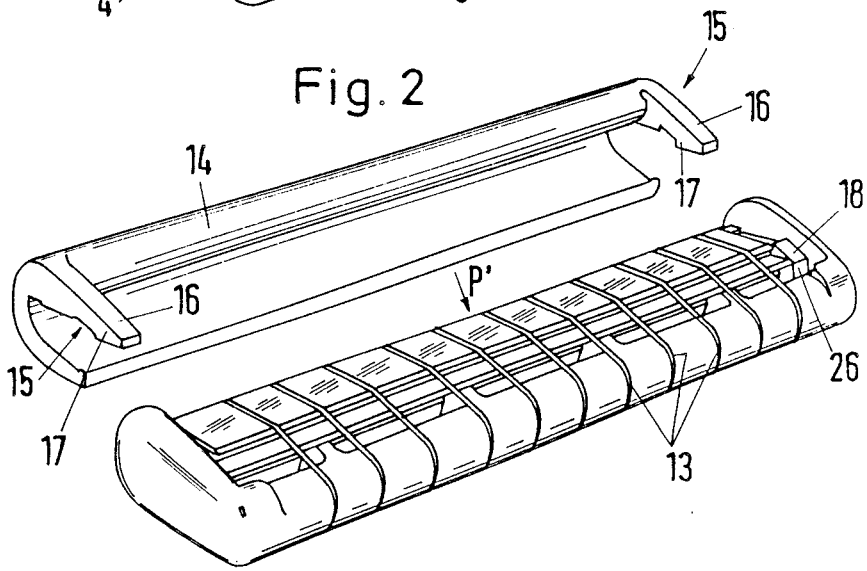
FIG. 2 is a view that shows the razor blade unit of FIG. 1 after the double razor blade has been inserted and wound with wire, but prior to placement of a U-shaped cap onto the plastic housing from the rear.
Figure 3:
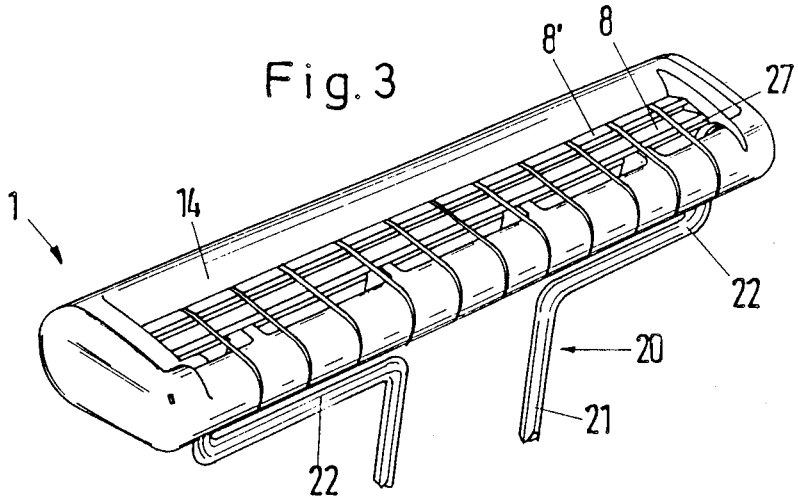
FIG. 3 is a view that shows the assembled razor blade unit, with a forked holder of a handle being indicated for the formation of a razor.
Figure 4:
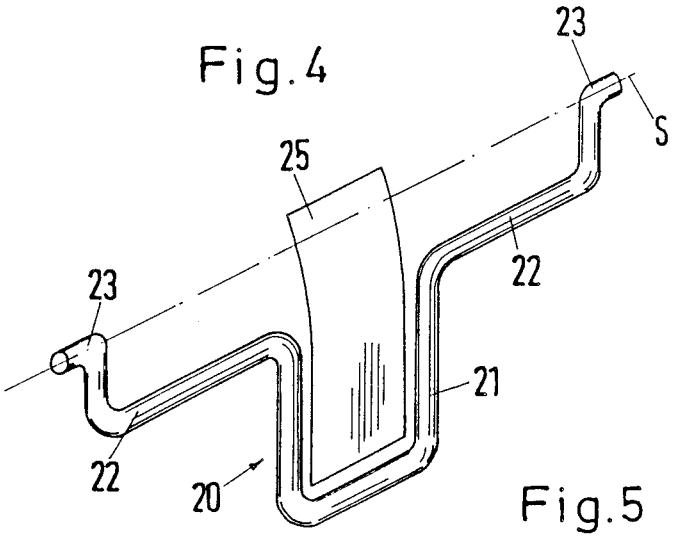
FIG. 4 is a view that shows the forked spring for the holder of the razor blade unit at the front end of the handle, and also shows a neutral position spring in the form of a flat spring.
Figure 5:
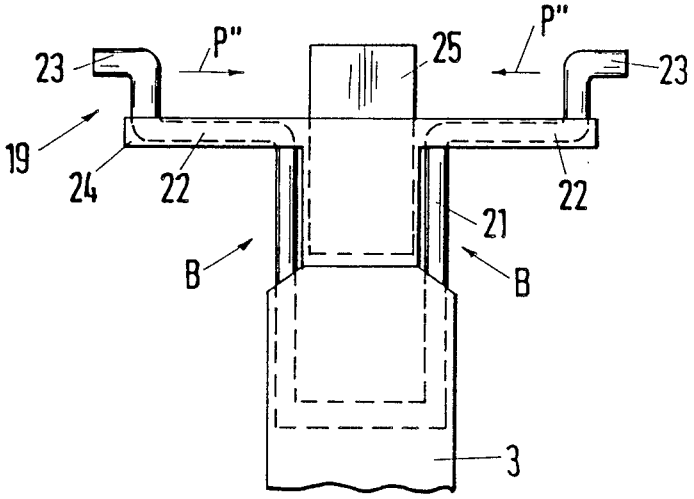
FIG. 5 is a view that shows the springs of FIG. 4 after installation in the handle of the razor.
Figure 6:
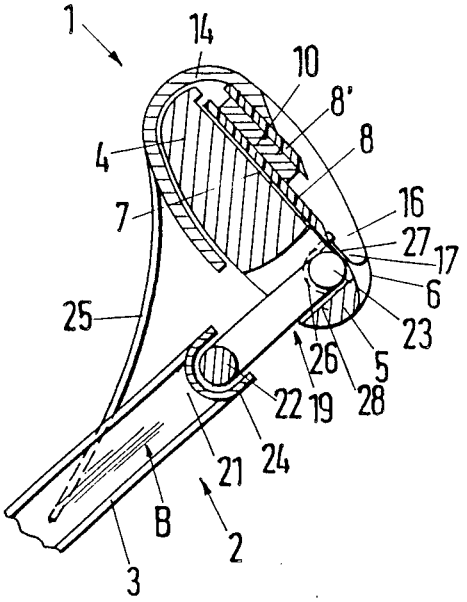
FIG. 6 is a schematic cross-sectional view through the head region of the inventive razor.

Referring now to the drawings in detail, Figs. 1 to 3 illustrate the various phases for the assembly of a razor blade unit 1, while the schematic cross-sectional view of FIG. 6 illustrates a complete razor 2, with the razor blade unit 1 of Figs. 1 to 3 having been secured to the front end of a handle 3. Parts of this handle 3 are illustrated in FIGS. 4 and 5.

The razor blade unit 1 comprises a one-piece plastic housing 4 that has a front guide strip 5, two side walls 6, and a blade platform or support 7 in the interior of the housing.

As shown in FIG. 1, inserted from above into the plastic housing 4 of the razor blade unit 1 through an opening 9 of the housing is a double razor blade comprised of the two blades 8, 8'. For this purpose, the two razor blades 8, 8' are fixedly secured to a flat, elongated, parallelepipedal spacer 10 in such a way that the spacer is sandwiched between the two razor blades 8, 8'. Thus, the razor blades 8, 8' and the spacer 10 form a so-called razor blade/spacer unit 11. As can be seen from FIG. 1, the spacer 10 is somewhat longer than the two razor blades 8, 8', so that the spacer 10 extends somewhat beyond the ends of the razor blades. In conformity with these extensions, each end of the blade support 7 of the razor blade unit 1 is provided with a respective recess 12 in the vicinity of the pertaining side wall 6.

As indicated in FIG. 1, the razor blade/spacer unit 11 is placed into the plastic housing 4 and onto the blade support 7 from above in the direction of the arrow P. Subsequently, as can be seen in FIG. 2, the plastic housing 4, together with the razor blade/spacer unit 11 inserted therein, is wrapped with wire 13.

Since the razor blade/spacer unit 11 is placed only loosely into the opening 9 of the plastic housing 4 and is held merely by the wire 13, a special fixation of the razor blade/spacer unit 11 within the plastic housing 4 must be provided. For this purpose, a cap 14 having an essentially U-shaped cross-sectional profile is provided. The cap 14 extends over the entire length of the plastic housing 4. The upper side of the cap 14 is provided with engagement means 15 comprising engagement arms 16 that extend toward the front from each end and that are each provided with a catch 17 at their front ends. The plastic housing 4 is provided with respective receiving means 18 that correspond to the catches 17.

As can be seen from FIG. 2, the cap 14 is placed onto the plastic housing 4 from behind in the direction of the arrow P' in such a way that the catches 17 of the cap 14 snap or otherwise engage in the receiving means 18 in the plastic housing 4. This finished assembled state of the razor blade unit 1 is illustrated in FIG. 3. Since the upper side of the cap 14 rests upon the razor blade/spacer unit 11, the latter is firmly secured on the blade support 7 of the plastic housing 4.

To form a razor 2, a handle 3 is provided for the razor blade unit 1. The front end of the handle 3 has a special forked holder 19 via which the handle 3 can catch or otherwise engage in the razor blade unit 1.

The forked holder 19 comprises a spring 20 in the form of a wire spring, which is illustrated in FIG. 4 by itself without the handle 3. The spring 20 primarily comprises a U-shaped base spring element 21, the front ends of which are bent outwardly at right angles to form fork arms 22. The front ends of the fork arms 22 are bent in the shape of an S and form pivot pins 23.

FIG. 5 shows how the spring 20 of the forked holder 19 is disposed in the front region of the handle 3. In this connection, the base of the U-shaped base spring element 21 is fixed within the handle 3 in such a way that the legs extend to the front. The fork arms 22 come to rest in a T-shaped extension 24 of the handle 3. As can be seen from FIG. 5, the legs of the base spring element 21 are exposed in the forward region. As a result, actuation or control regions B are formed, so that by pressing together the legs of the base spring element 21, the pivot pins 23 of the spring 20 can be pivoted inwardly toward one another. This is indicated by the arrows P''. After the legs of the base spring element 21 are released, the pivots pins 23 return to their starting position.

Furthermore shown in FIGS. 4 and 5 is a so-called neutral position spring 25, which in the illustrated embodiment is shown as a flat spring of plastic or metal: the bottom or rear end of the spring 25 is disposed in the handle 3. Instead of being embodied as a flat spring, the spring 25 could also be embodied as a U spring, a leg spring, etc. The technical significance of the neutral position spring 25 will be explained subsequently with the aid of FIG. 6.

To secure the handle 3 to the razor blade unit 1, the pivot pins 23 are first pivoted inwardly in the manner described above. As a result, the forked holder 19 can be introduced into the razor blade unit 1, as can be seen in particular in FIGS. 3 and 6. In this connection the razor blade unit 1 is provided in the region of its side walls 6 with respective recesses 26 into which the pivot pins 23 of the forked holder 19 can engage after the spring 20 is released. As can be seen in particular in FIG. 6, the pivot axis S that is defined by the pivot pins 23 is disposed in the region of the cutting edge 27 of the forward razor blade 8, i.e. the pivot axis S extends in front of this cutting edge 27 and parallel thereto, as well as somewhat offset below the plane of this forward razor blade 8. As can be furthermore seen in FIG. 6, the neutral position spring 25 presses the razor blade unit 1 toward the front against a stop 28 within the plastic housing 4. During the shaving process, the razor blade unit 1 can therefore be pivoted only to the rear against the force of the neutral position spring 25, with the pivot range being between 15 and 30°.

The present invention is, of course, in no way restricted to the specific disclosure of the specification and drawings, but also encompasses any modifications within the scope of the appended claims.

What I claim is:

1. In a razor head, especially a razor blade unit, having razor blade means fixedly disposed in a plastic housing and resting on a blade support of said plastic housing, whereby if said razor blade means is a double razor blade, a spacer is disposed between the two blades thereof, the improvement wherein:

said plastic housing has an opening for said razor blade means, with said opening being accessible from above, and with said razor blade means being introduced into said opening from above onto said blade support of said plastic housing;

a cover means is placed on said plastic housing to both thereby fixedly and firmly hold said cover means in a secured position on said plastic housing, with said razor blade means also being fixed unreleasably on said blade support in a location between said cover means and said blade support of said plastic housing; and engagement means is provided between said cover means and said plastic housing; said cover means being a cap that has an essentially U-shaped cross-sectional profile, is placed upon said plastic housing from the rear, and extends over essentially the entire length of said plastic housing.

2. A razor head according to claim 1, in which said cap has ends; and in which said engagement means includes, on each of said ends of said cap, an engagement arm that extends toward the front and is provided with a catch which is received in cooperating receiving means of said plastic housing.

3. A razor head according to claim 1, in which said cover means is made of a material that can contract.

4. A razor head according to claim 3, in which said material of said cover means is plastic.

5. A razor head according to claim 1, in which a lubricating film is applied onto said cover means to enhance sliding so that the coefficient of friction between the razor head and user skin is reduced during shaving, thus providing a comfortable shave due to reduced friction.

6. A razor head according to claim 5, in which said cover means is made of plastic.

7. A razor head according to claim 2, in which wire means is wrapped around said plastic housing together with said razor blade means introduced from above.

8. A razor head according to claim 2, in which a stop is provided within said plastic housing, and a spring means presses said razor blade means forward as a razor blade unit against said stop within said plastic housing.

9. A razor head according to claim 8, in which, during a shaving process, said razor blade unit can be pivoted only rearwardly against the force of said spring means.

10. A razor head according to claim 9, in which said razor blade unit can be pivoted in a pivot range of between 15° and 30°.

* * * * *